US012364286B2

(12) United States Patent
Forster et al.

(10) Patent No.: US 12,364,286 B2
(45) Date of Patent: Jul. 22, 2025

(54) AEROSOL PROVISION DEVICE

(71) Applicant: NICOVENTURES TRADING LIMITED, London (GB)

(72) Inventors: Mark Forster, London (GB); Will England, London (GB); Luke Warren, London (GB)

(73) Assignee: NICOVENTURES TRADING LIMITED, London (GB)

( * ) Notice: Subject to any disclaimer, the term of this patent is extended or adjusted under 35 U.S.C. 154(b) by 828 days.

(21) Appl. No.: 17/596,294

(22) PCT Filed: Jun. 8, 2020

(86) PCT No.: PCT/EP2020/065886
§ 371 (c)(1),
(2) Date: Dec. 7, 2021

(87) PCT Pub. No.: WO2020/245471
PCT Pub. Date: Dec. 10, 2020

(65) Prior Publication Data

US 2022/0232896 A1 Jul. 28, 2022

(30) Foreign Application Priority Data

Jun. 7, 2019 (GB) ..... 1908194

(51) Int. Cl.
*A24F 40/485* (2020.01)
*A24F 40/465* (2020.01)

(52) U.S. Cl.
CPC ..... *A24F 40/485* (2020.01); *A24F 40/465* (2020.01)

(58) Field of Classification Search
None
See application file for complete search history.

(56) References Cited

U.S. PATENT DOCUMENTS 9,814,272 B2 * 11/2017 Li ..... A24F 40/485
2016/0044963 A1 * 2/2016 Saleem ..... A24F 40/46 131/328
2016/0143355 A1 * 5/2016 Borges ..... A24D 1/22 131/329

FOREIGN PATENT DOCUMENTS

CN 204146324 U 2/2015
CN 105341993 A 2/2016
CN 207236075 U 4/2018
(Continued)

OTHER PUBLICATIONS

International Search Report and Written Opinion for Application No. PCT/EP2020/065886, mailed on Sep. 25, 2020, 13 pages.
(Continued)

*Primary Examiner* — Tho D Ta
(74) *Attorney, Agent, or Firm* — Merchant & Gould P.C.

(57) ABSTRACT

Aerosol provision devices are disclosed and can be configured for generating aerosol from aerosol-generating material. These devices can include a heating chamber for receiving the aerosol-generating material; at least one heating unit for heating the aerosol-generating material during a session of use; and an aperture, which fluidically connects the heating chamber with the exterior of the aerosol provision device. The aperture is suitably configured to reduce the risk of condensate accumulating within the device during use. The aperture can be non-circular. In some embodiments the device can include a plurality of apertures.

22 Claims, 7 Drawing Sheets

(56) References Cited

FOREIGN PATENT DOCUMENTS

| | | | | |
|---|---|---|---|---|
| JP | 2010506594 | A | 3/2010 | |
| JP | 2014504852 | A | 2/2014 | |
| JP | 2014519850 | A | 8/2014 | |
| JP | 2015504667 | A | 2/2015 | |
| JP | 2019510470 | | 4/2019 | |
| RU | 2667228 | C1 | 9/2018 | |
| WO | WO-2017108992 | A1 * | 6/2017 | ..... A24B 15/167 |
| WO | WO-2017194762 | A1 | 11/2017 | |
| WO | WO-2018224677 | A2 | 12/2018 | |
| WO | 2019082056 | | 5/2019 | |

OTHER PUBLICATIONS

International Preliminary Report on Patentability for Application No. PCT/EP2020/065886, dated Dec. 7, 2021, 7 pgs.
RU Office Action in RU Appln. No. 2021135867, dated Jul. 26, 2022, 15 pages.

* cited by examiner

AEROSOL PROVISION DEVICE

PRIORITY CLAIM

The present application is a National Phase entry of PCT Application No. PCT/EP2020/065886, filed Jun. 8, 2020, which claims priority from GB Patent Application No. 1908194.2, filed Jun. 7, 2019, each of which is hereby fully incorporated herein by reference.

TECHNICAL FIELD

The present disclosure relates to an aerosol provision device, a method of generating an aerosol using the aerosol provision device, and an aerosol-generating system comprising the aerosol provision device.

BACKGROUND

Articles such as cigarettes, cigars and the like burn tobacco during use to create tobacco smoke. Attempts have been made to provide alternatives to these types of articles, which burn tobacco, by creating products that release compounds without burning. Apparatus is known that heats smokable material to volatilize at least one component of the smokable material, typically to form an aerosol which can be inhaled, without burning or combusting the smokable material. Such apparatus is sometimes described as a "heat-not-burn" apparatus or a "tobacco heating product" (THP) or "tobacco heating device" or similar. Various different arrangements for volatilizing at least one component of the smokable material are known.

The material may be, for example, tobacco or other non-tobacco products or a combination, such as a blended mix, which may or may not contain nicotine.

SUMMARY

According to a first aspect of the present disclosure, there is provided an aerosol provision device for generating aerosol from aerosol-generating material, the device comprising: a heating chamber for receiving the aerosol-generating material; at least one heating unit for heating the aerosol-generating material during a session of use; and an aperture, which fluidically connects the heating chamber with the exterior of the aerosol provision device; wherein the aperture is non-circular and has a smallest dimension, as measured through the centroid of the aperture, of less than or equal to 0.65 mm.

According to a second aspect of the present disclosure, there is provided an aerosol provision device for generating aerosol from aerosol-generating material, the device comprising: a heating chamber for receiving the aerosol-generating material; at least one heating unit for heating the aerosol-generating material during a session of use; and an aperture, which fluidically connects the heating chamber with the exterior of the aerosol provision device; wherein the aperture has a perimeter of less than or equal to 3.40 mm.

According to a third aspect of the present disclosure, there is provided an aerosol provision device for generating aerosol from aerosol-generating material, the device comprising: a housing; a heating chamber, located within the housing, for receiving the aerosol-generating material; at least one inductive heating unit for heating the aerosol-generating material during a session of use; and an aperture, which fluidically connects the heating chamber with the exterior of the aerosol provision device; wherein the aperture has an area of less than or equal to 0.65 $mm^2$.

According to a fourth aspect of the present disclosure, there is provided an aerosol provision device for generating aerosol from aerosol-generating material, the device comprising: a housing; a heating chamber, located within the housing, for receiving the aerosol generating material; at least one inductive heating unit for heating the aerosol-generating material during a session of use; and a plurality of apertures, the or each fluidically connecting the heating chamber with the exterior of the aerosol provision device; wherein the plurality of apertures has a total combined area of less than 4.00 $mm^2$.

Further features and advantages of the invention will become apparent from the following description of preferred embodiments of the invention, given by way of example only, which is made with reference to the accompanying drawings.

DETAILED DESCRIPTION

To facilitate formation of an aerosol in use, aerosol-generating material for aerosol-provision devices (e.g. tobacco heating products) usually contains more water and/or aerosol-generating agent than the smokeable material within combustible smoking articles. This higher water and/or aerosol-generating agent content can increase the risk of condensate collecting within the aerosol-provision device during use, particularly in locations away from the heating unit(s).

The inventors consider that this problem may be greater in devices with enclosed heating chambers. In some such devices, the heating chamber may be fluidically connected, in parallel, with the exterior of the device by several apertures, which may, for example, regulate the flow of air into the device.

Having studied the results of tests of devices having such apertures, the inventors consider that the apertures may be a significant contributing factor to the collection of condensate within the device. Furthermore, the inventors foresee a risk that any condensate that does accumulate within the device may leak out through the apertures, with such leakage inconveniencing the user of the device.

However, the inventors have determined that suitably configured apertures may reduce the risk of such leakage of condensate from the device.

Figure 1:
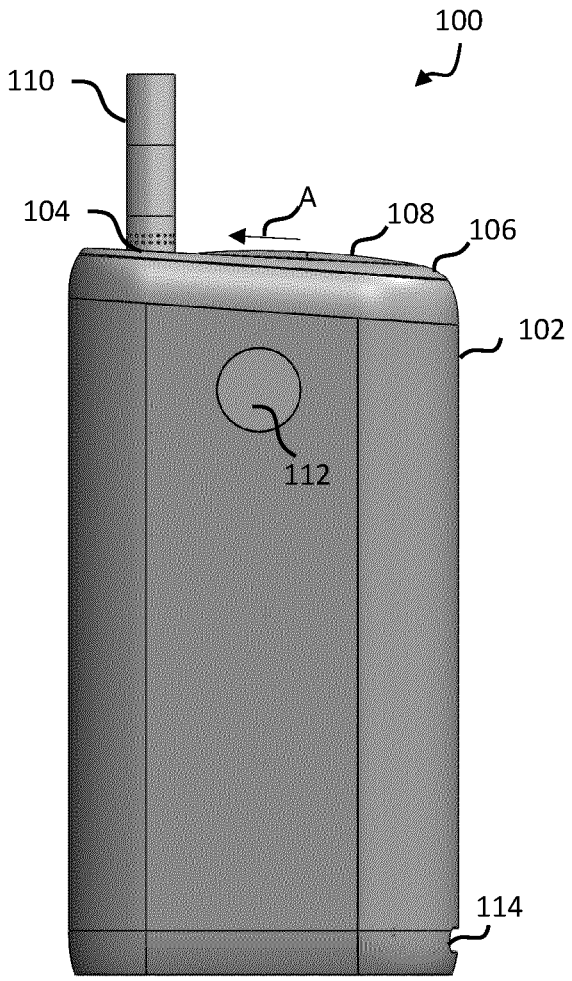
FIG. 1 shows a front view of an example of an aerosol provision device.

In this regard, reference is directed to FIG. 1, which is a front view of an example of an aerosol provision device 100 for generating aerosol from an aerosol-generating medium/material. In broad outline, the device 100 may be used to heat a replaceable article 110 comprising the aerosol-generating medium, to generate an aerosol or other inhalable medium which is inhaled by a user of the device 100.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

Figure 2:
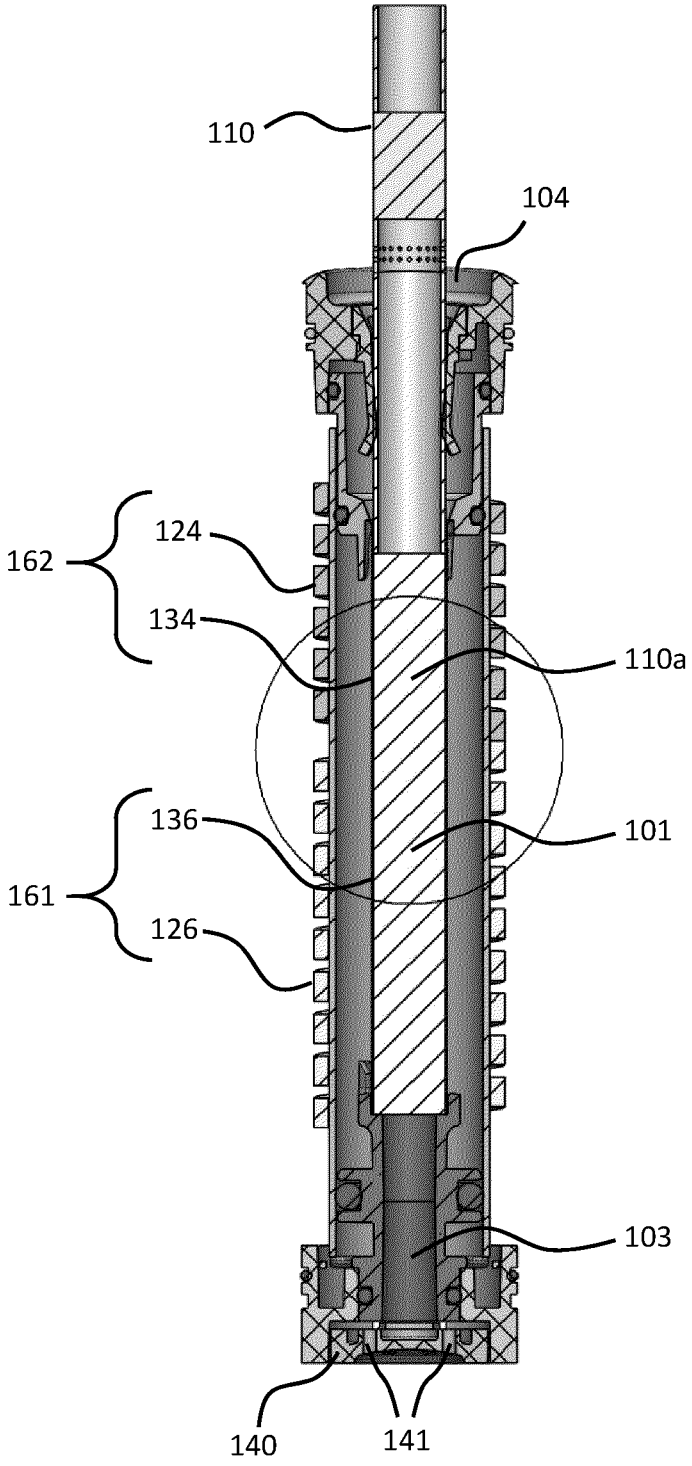
FIG. 2 shows an enlarged cross-sectional view of a heating assembly within an aerosol provision device.

FIG. 2 depicts a cross-sectional view of the heating assembly and neighboring components within the device 100 of FIG. 1. As shown, the device 100 includes a heating chamber 101 for receiving the aerosol-generating material 110*a*. The device 100 additionally includes a number of apertures 141. As is apparent, the apertures 141 fluidically connect, in parallel, the heating chamber 101 with the exterior of the device 100.

Apertures 141 may provide suitable impedance to the flow of air into the device, so as to regulate the flow of air through the device 100. However, such impedance may equally increase the risk that condensate collects within the device 100, for example in inlet conduit 103. Additionally, as mentioned above, there is a risk that such accumulated condensate leaks from the device, inconveniencing the user. Nonetheless, by configuration of the device 100, in accordance with any of the aspects of this disclosure, the risk of condensate leaking from the device 100 may be substantially reduced.

As also shown in FIG. 2, the device 100 includes two heating units 161, 162 for heating the aerosol-generating material 110*a*. Although the illustrated example includes two heating units 161, 162, it should be understood that this is by no means essential and the device 100 could include only one heating unit, or could include three or more heating units, as appropriate.

The inventors have studied the results of tests of devices of similar construction to the device 100 of FIGS. 1 and 2. Based on these test results, the inventors foresee a particular risk that condensate collects within the device 100. A possible contributing factor is that, in many cases, for condensate-forming substances to exit the device 100 would involve them travelling in the opposite direction to the flow of air through the apertures 141 and into the device 100 during use. An additional contributing factor is that the apertures 141, which fluidically connect the inlet conduit 103 with the exterior of the device, offer resistance or impedance to the flow of air into the device, so as to regulate the flow of air through the device 100; however, such resistance/impedance hinders the exit of condensate-forming substances from the inlet conduit 103, through the apertures 141.

Moreover, as noted above, where condensate does accumulate within the device, there is a risk that it leaks out of the device, inconveniencing the user.

Nonetheless, by studying the test results, the inventors believe that they have determined suitable approaches for configuring the apertures 141 to reduce the risk of condensate leaking from the device 100.

According to a first approach, the apertures 141 of the device 100 may be configured so as to be non-circular and to each have a smallest dimension (as measured through the centroid of the aperture in question) of less than or equal to 0.65 mm. Testing indicates that devices with such apertures are effective at preventing the leakage of condensate.

Without wishing to be bound by the theory, it is hypothesized that the fluidic resistance forces that inhibit condensate from passing through a given aperture may, in at least some cases, be related to the smallest dimension of the aperture, for example because this smallest dimension is indicative of capillary forces. A device having non-circular apertures with a smallest dimension of less than or equal to 0.65 mm may therefore, potentially as a result of such capillary forces, provide a suitable level of impedance to retain condensate within the device. On the other hand, the aperture's other dimensions may be selected so as to provide a suitable area for the aperture, for example so as to achieve a desired level of impedance to air flow.

Based on experimental results, the inventors consider that, in many cases, a smallest dimension of less than or equal to 0.625 mm may be sufficient to cause a significant reduction in the risk of leakage of condensate. Nonetheless, in some cases, the apertures may be configured with a smallest dimension of less than or equal to 0.60 mm.

According to a second approach, the apertures 141 of the device 100 may be configured so as to have a perimeter of less than or equal to 3.40 mm. Testing indicates that devices with such apertures are effective at preventing the leakage of condensate. Again, without wishing to be bound by the theory, it is hypothesized that, in many cases, the frictional forces experienced by liquid passing through a given aperture may be related to the perimeter of the aperture. Accordingly, apertures with relatively small perimeters may be effective at preventing the leakage of condensate.

Based on experimental results, the inventors consider that, in many cases, a perimeter of less than or equal to 3.40 mm may be sufficient to cause a significant reduction in the risk of leakage of condensate. Nonetheless, in some cases, the apertures may be configured with a perimeter of less than or equal to 3.25 mm, in other cases less than or equal to 3.00 mm.

According to a third approach, the apertures 141 of the device may be configured so as to have an area of less than or equal to 0.65 $mm^2$. Testing indicates that devices with such apertures are effective at preventing the leakage of condensate. Again, without wishing to be bound by the theory, it is hypothesized that the ability of liquid to pass through a given aperture may be inversely related to the area of that aperture because, where a given pressure is present within a liquid (e.g. as a result of gravity), and that pressure is applied over a smaller area, a smaller total force is imparted on the fluid. Accordingly, apertures with relatively small areas may be effective at preventing the leakage of condensate.

Based on experimental results, the inventors consider that, in many cases, an area of less than or equal to 0.65 $mm^2$ may be sufficient to cause a significant reduction in the risk of leakage of condensate. Nonetheless, in some cases, the apertures may be configured with an area of less than or equal to 0.60 $mm^2$, in other cases less than or equal to 0.55 $mm^2$. It will be appreciated that combinations of the above approaches may be employed when configuring a given aperture. For example, apertures might be configured so as to each have a smallest dimension of less than or equal to 0.65 mm and/or a perimeter of less than or equal to 3.40 mm and/or an area of less than or equal to 0.65 $mm^2$.

Returning now to FIG. 2, it may be noted that, in the particular example device shown, the heating units 161, 162 are inductive heating units. Inductive heating units may provide rapid heating of aerosol-generating material. However, the inventors consider such rapid heating may be a risk factor for the accumulation of condensate, for example because inductive heating units may generate condensate-forming substances at a greater rate than they can be carried away through apertures 141.

In the particular example device 100 shown in FIG. 2, each inductive heating unit 161, 162 comprises a respective coil 124, 126 and a respective heating element 134, 136. In the particular example shown, the electrically-conductive heating elements 134, 136 of the two heating units 161, 162 correspond to respective sections of a single metal tube 132. However, in other examples, each heating element may be a separate and distinct structure.

In general, the coil of an inductive heating unit may, for example, be configured to cause heating of one or more electrically-conductive heating elements, for instance so that heat energy is conductible from such electrically-conductive heating elements to aerosol-generating material to thereby cause heating of the aerosol-generating material. An inductive heating unit may be configured to cause the coil to generate a varying magnetic field for penetrating the at least one heating element, to thereby cause induction heating of the at least one heating element. In the device 100 shown in FIG. 2, the coil 124, 126 of each inductive heating unit 161, 162 causes heating of its corresponding electrically-conductive heating element 134, 136. Each heating element 134, 136 then conducts heat to the aerosol-generating material 110*a*.

As will be appreciated, heating units other than induction heating units might be employed in other examples. For instance, the device might include one or more resistive heating units. As an example, a resistive heating unit could be substituted for each of inductive heating units 161, 162. A resistive heating unit may comprise (or consist essentially of) one or more resistive heating elements. By "resistive heating element", it is meant that on application of a voltage to the element, current flows within the element, with electrical resistance in the element transducing electrical energy into thermal energy which heats the aerosol-generating substrate. A resistive heating element may, for example, be in the form of a resistive wire, mesh, coil and/or a plurality of wires. The heat source may be a thin-film heater.

As is also apparent from FIG. 2, the particular device 100 shown additionally includes an inlet conduit 103, which fluidically connects the heating chamber 101 with the exterior of the device 100. During use, air may be drawn into the device 100, through the apertures 141, before flowing along inlet conduit 103 and later into heating chamber 101. Thus, the apertures 141 fluidically connect, in parallel, the inlet conduit 103 (as well as heating chamber 101) with the exterior of the device 100.

It may additionally be noted that, in the specific example shown in FIG. 2, the distal end of the inlet conduit 103 is adjacent the apertures 141 and thus each aperture 141 opens, on one side, to the distal end of the inlet conduit 103, and, at an opposite side, to the exterior of the device 100.

Figure 3:
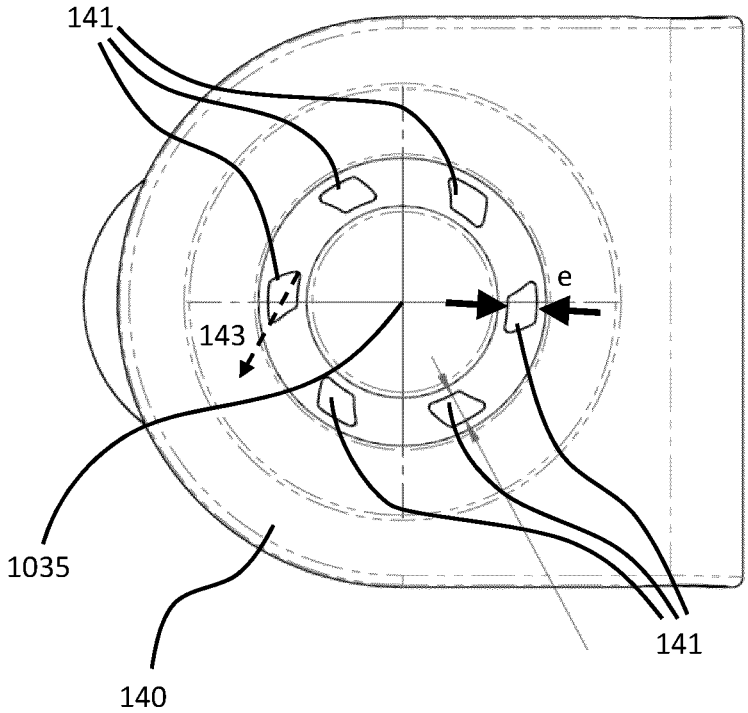
FIG. 3 shows a plan view of a door of the aerosol provision device of FIG. 1.

Reference is now directed to FIG. 3 which is a plan view of the part of the device 100 in which apertures 141 are formed; that part of the device is a door but it could be any other component.

In the particular example shown, the device 100 includes six apertures 141. However, any suitable number of apertures could be included as a plurality of apertures; for instance, some embodiments might have as few as four apertures, whereas other embodiments might have as many as eight or ten apertures 141. Alternatively, a single aperture could be provided.

As illustrated in FIG. 3, the apertures 141 may be distributed circumferentially about a longitudinal axis 1035 of the inlet conduit 103. More particularly, the apertures 141 are arranged in a ring-shaped array. In the example shown, the center of the ring-shaped array is defined by an axis 1035 of the inlet conduit 103, optionally a longitudinal axis of the inlet conduit 103.

As is apparent from FIG. 3, in the particular example shown 3, the apertures 141 are spaced substantially equidistantly. This may, for example, ensure a smooth and stable flow of air into the device 100. However, this is by no means essential and in other embodiments groups of the apertures 141 could be clustered together.

As is also apparent from FIG. 3, each aperture 141 has a largest dimension 143, as measured through the centroid of the aperture, that is directed generally circumferentially (i.e. it lies in a direction that is closer to a circumferential direction than to a radial direction, as defined relative to the longitudinal axis 1035 of the inlet conduit 103). Such an arrangement may, for example, tend to cause in-flowing air to adopt a helical flow pattern, which may, in some cases, lead to a smooth and stable flow of air into the device 100. The largest dimension 143 may be less than or equal to 1.20 mm, as measured through the centroid of the aperture.

It may further be noted that each of the apertures 141 is shaped as a regular polygon. However, in other embodiments the apertures 141 could be shaped as irregular polygons.

Furthermore, while each aperture 141 in the device of may have substantially the same shape, this is by no means essential and in other embodiments two or more groups of apertures could be provided, where all the apertures in a group have substantially the same shape. Where there is only one aperture, it could be shaped as described above.

Reference is next directed to FIGS. 4-7B, which illustrate various features of the construction and operation of the devices of FIGS. 1-3.

Figure 4:
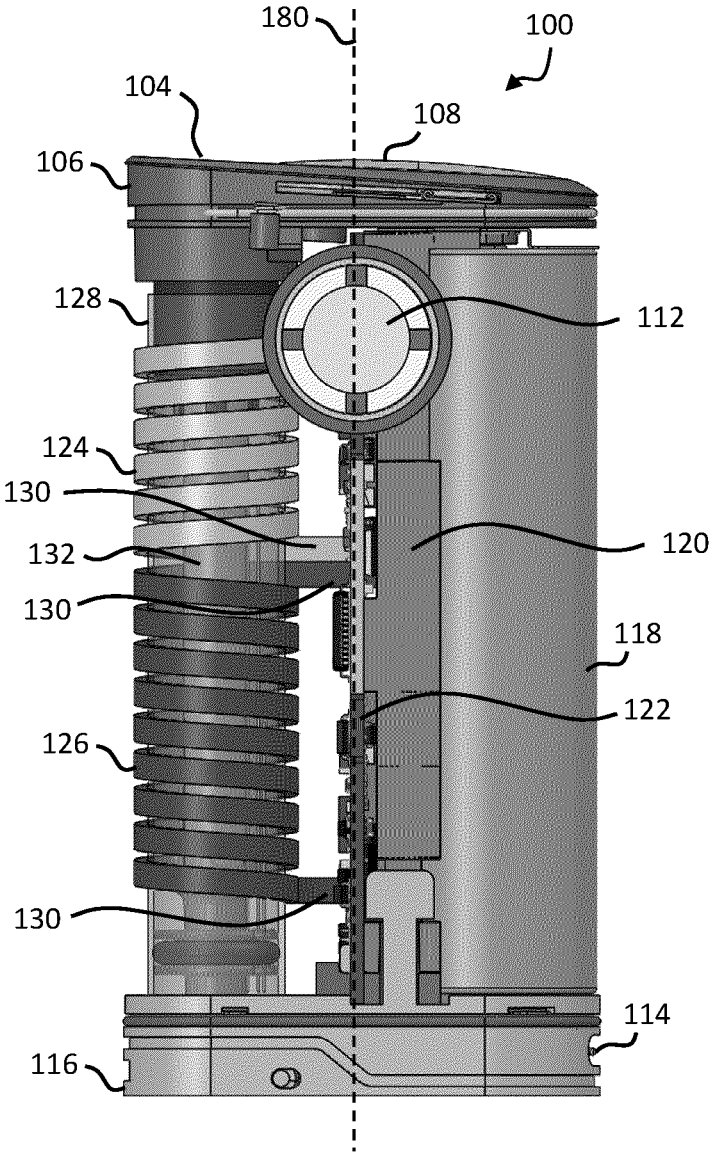
FIG. 4 shows a front view of the aerosol provision device of FIG. 1 with an outer cover removed.

Turning first to FIG. 4, as shown, the device 100 may comprise a first end member 106 which comprises a lid 108 which is moveable relative to the first end member 106 to close the opening 104 when no article 110 is in place. In FIG. 1, the lid 108 is shown in an open configuration, however the lid 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

FIG. 4 depicts the device 100 of FIG. 1 with the outer cover 102 removed and without an article 110 present. The device 100 defines a longitudinal axis 180.

As shown in FIG. 4, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol-generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 may further comprise a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol-generating material. In this example, the battery is connected to a central support 120 which holds the battery 118 in place.

The device may further comprise at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

As noted above, in the example device 100, the heating assembly is an inductive heating assembly and comprises various components to heat the aerosol-generating material 110*a* via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section 134 of the susceptor 132 and the second inductor coil 126 is configured to generate a second varying magnetic field for heating a second section 136 of the susceptor 132. Thus, as discussed above with reference to FIG. 2, first inductor coil 124 and first section 134 of susceptor 132 may be considered part of a first heating unit 161, in which first section 134 of susceptor 132 acts as a heating element, generating heat that is transferred to the aerosol-generating material. By contrast, second inductor coil 126 and second section 136 of susceptor 132 may be considered part of a second heating unit 162, in which second section 136 of susceptor 132 acts as a heating element, generating heat that is transferred to the aerosol-generating material.

In the example shown in FIG. 4, the first inductor coil 124 is adjacent to the second inductor coil 126 in a direction along the longitudinal axis 180 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section/portion of the article 110, and at a later time, the second inductor coil 126 may be operating to heat a second section/portion of the article 110. Winding the coils in opposite directions helps reduce the current induced in the inactive coil when used in conjunction with a particular type of control circuit. In FIG. 4, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a heating chamber 101 within which aerosol-generating material is received. For example, the article 110 can be inserted into the susceptor 132. In this example the susceptor 120 is tubular, with a circular cross section.

The susceptor 132 may be made from one or more materials. Optionally, the susceptor 132 comprises carbon steel having a coating of Nickel or Cobalt.

In some examples, the susceptor 132 may comprise at least two materials capable of being heated at two different frequencies for selective aerosolization of the at least two materials. For example, a first section of the susceptor 132 (which is heated by the first inductor coil 124) may comprise a first material, and a second section of the susceptor 132 which is heated by the second inductor coil 126 may comprise a second, different material. In another example, the first section may comprise first and second materials, where the first and second materials can be heated differently based upon operation of the first inductor coil 124. The first and second materials may be adjacent along an axis defined by the susceptor 132, or may form different layers within the susceptor 132. Similarly, the second section may comprise third and fourth materials, where the third and fourth materials can be heated differently based upon operation of the second inductor coil 126. The third and fourth materials may be adjacent along an axis defined by the susceptor 132, or may form different layers within the susceptor 132. Third material may the same as the first material, and the fourth material may be the same as the second material, for example. Alternatively, each of the materials may be different. The susceptor may comprise carbon steel or aluminum for example.

The device 100 of FIG. 4 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 4, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 5:
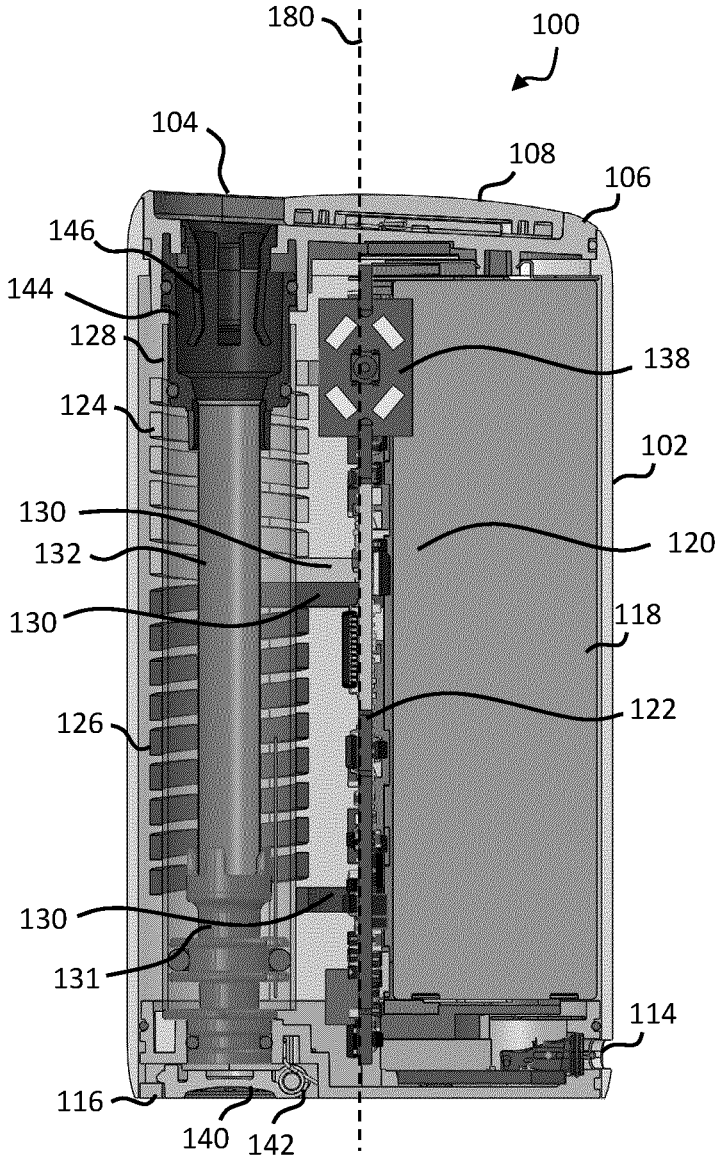
FIG. 5 shows a cross-sectional view of the aerosol provision device of FIG. 1.

FIG. 5 shows a cross-sectional view of device 100. The outer cover 102 is present in this example. The rectangular cross-sectional shape of the first and second inductor coils 124, 126 is more clearly visible.

The device 100 further comprises inlet conduit support component 131 which, in the particular example illustrated, engages one end of the susceptor tube 132 to hold the susceptor tube 132 in place. The inlet conduit support component 131 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor tube 132. A user may open the second lid 140 to clean the susceptor tube 132 and/or the interior surface of inlet conduit 103.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 6:
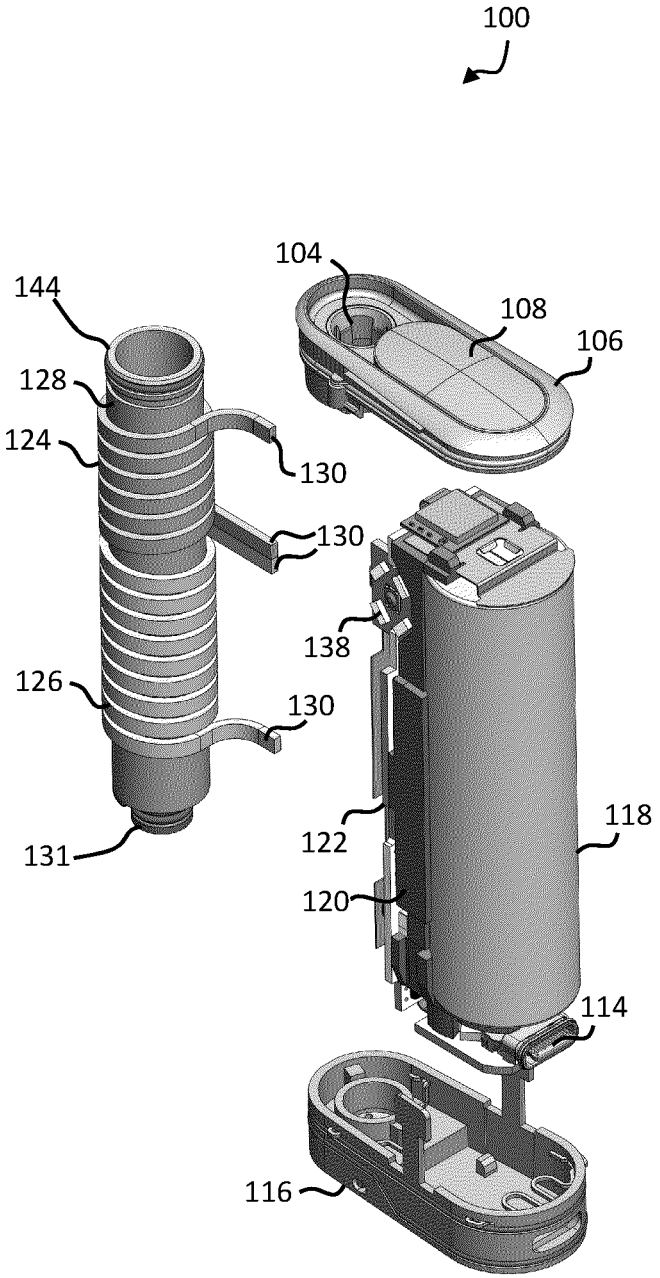
FIG. 6 shows an exploded view of the aerosol provision device of FIG. 4.

FIG. 6 is an exploded view of the device 100 of FIG. 1, with the outer cover 102 omitted.

Figure 7A:
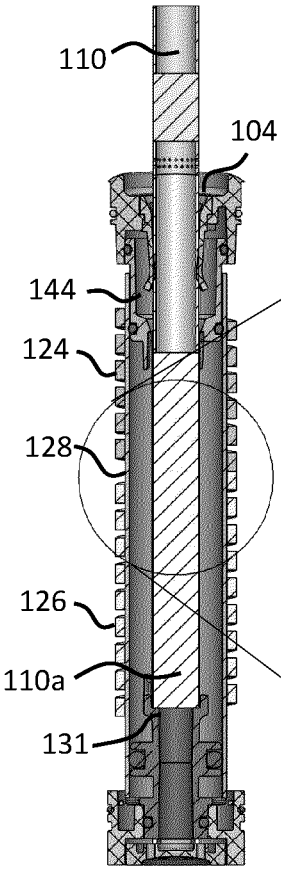
FIG. 7A shows a cross-sectional view of a heating assembly within an aerosol provision device.
Figure 7B:
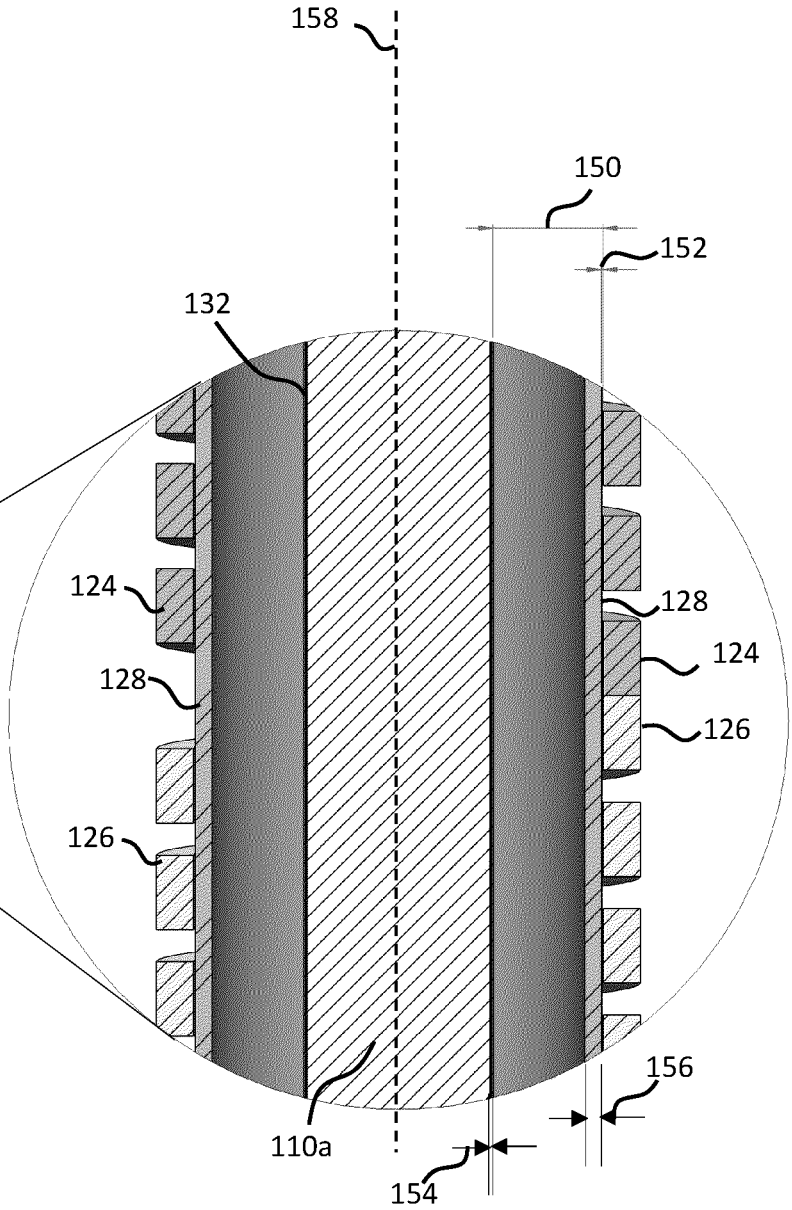
FIG. 7B shows a close-up view of a portion of the heating assembly of FIG. 7A.

FIG. 7A depicts a cross-section of a portion of the device 100 of FIG. 4. FIG. 7B depicts a close-up of a region of FIG. 7A. FIGS. 7A and 7B show the article 110 received within the susceptor 132, where the article 110 is dimensioned so that the outer surface of the article 110 abuts the inner surface of the susceptor 132. This ensures that the heating is most efficient. The article 110 of this example comprises aerosol-generating material 110*a*. The aerosol-generating material 110*a* is positioned within the susceptor 132. The article 110 may also comprise other components such as a filter, wrapping materials and/or a cooling structure.

FIG. 7B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 7B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm.

"Session of use" as used herein refers to a single period of use of the aerosol-provision device by a user. The session of use begins at the point at which power is first supplied to at least one heating unit present in the heating assembly. The device will be ready for use after a period of time has elapsed from the start of the session of use. The session of use ends at the point at which no power is supplied to any of the heating elements in the aerosol-provision device. The end of the session of use may coincide with the point at which the smoking article is depleted (the point at which the total particulate matter yield (mg) in each puff would be deemed unacceptably low by a user). The session will have a duration of a plurality of puffs. Said session may have a duration less than 7 minutes, or 6 minutes, or 5 minutes, or 4 minutes and 30 seconds, or 4 minutes, or 3 minutes and 30 seconds. In some embodiments, the session of use may have a duration of from 2 to 5 minutes, or from 3 to 4.5 minutes, or 3.5 to 4.5 minutes, or suitably 4 minutes. A session may be initiated by the user actuating a button or switch on the device, causing at least one heating element to begin rising in temperature.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device for generating aerosol from aerosol-generating material, the aerosol provision device comprising:

a heating chamber for receiving the aerosol-generating material;

at least one heating unit for heating the aerosol-generating material during a session of use;

an aperture which fluidically connects the heating chamber with an exterior of the aerosol provision device; and an inlet conduit, which fluidly connects the aperture to the heating chamber;

wherein the aperture is arranged at a distal end of the device, the distal end being an opposed end to a mouth end of the aerosol provision device, wherein the aperture is at least one of:

non-circular and having a smallest dimension, as measured through a centroid of the aperture, of less than or equal to 0.65 mm, or defined by a perimeter of less than or equal to 3.40 mm, and wherein the aperture is configured to reduce the risk of condensate leaking from the aerosol provision device during use.

2. The aerosol provision device of claim 1, wherein the aperture has an area of less than or equal to 0.65 $mm^2$.

3. The aerosol provision device of claim 1, wherein the at least one heating unit is an inductive heating unit.

4. The aerosol provision device of claim 1, wherein the aperture has an area of less than or equal to 0.60 $mm^2$.

5. The aerosol provision device of claim 1, wherein the aperture has an area of less than or equal to 0.55 $mm^2$.

6. The aerosol provision device of claim 1, wherein the aperture is shaped as a regular polygon.

7. The aerosol provision device of claim 1, wherein the aperture is shaped as an irregular polygon.

8. A method of generating aerosol using the aerosol provision device of claim 1.

9. A system for generating aerosol from aerosol-generating material, the system comprising the aerosol provision device as claimed in claim 1, and the aerosol-generating material.

10. The aerosol provision device of claim 1, wherein the aperture has a largest dimension of less than or equal to 1.20 mm, as measured through the centroid of the aperture.

11. The aerosol provision device of claim 10, wherein the largest dimension lies in a direction that is closer to a circumferential direction than to a radial direction, as defined relative to an axis of the inlet conduit.

12. The aerosol provision device of claim 1, wherein the aperture is one of a plurality of apertures.

13. The aerosol provision device of claim 12, wherein the plurality of apertures are distributed circumferentially about a longitudinal axis of the inlet conduit.

14. The aerosol provision device of claim 12, wherein the plurality of apertures are spaced substantially equidistantly.

15. The aerosol provision device of claim 12, wherein the plurality of apertures are arranged in a ring-shaped array.

16. The aerosol provision device of claim 12, wherein the plurality of apertures have a combined area of less than or equal to 4.00 $mm^2$.

17. The aerosol provision device of claim 12, wherein the plurality of apertures have a combined area of less than or equal to 3.50 $mm^2$.

18. The aerosol provision device of claim 12, wherein the plurality of apertures comprises at least four apertures.

19. The aerosol provision device of claim 12, wherein the plurality of apertures comprises at most eight apertures.

20. The aerosol provision device of claim 12, wherein each aperture in the plurality of apertures has substantially the same shape.

21. An aerosol provision device for generating aerosol from aerosol-generating material, the aerosol provision device comprising:

a housing;

a heating chamber located within the housing for receiving the aerosol-generating material;

at least one inductive heating unit for heating the aerosol-generating material during a session of use;

an aperture which fluidically connects the heating chamber with an exterior of the aerosol provision device; and an inlet conduit, which fluidically connects the aperture to the heating chamber;

wherein the aperture is arranged at a distal end of the device, the distal end being an opposite end to a mouth end of the aerosol provision device, wherein the aperture has an area of less than or equal to 0.65 $mm^2$; and wherein the aperture is configured to reduce the risk of condensate leaking from the aerosol provision device during use.

22. An aerosol provision device for generating aerosol from aerosol-generating material, the aerosol provision device comprising:

a housing;

a heating chamber located within the housing for receiving the aerosol generating material;

at least one inductive heating unit for heating the aerosol-generating material during a session of use;

a plurality of apertures fluidically connecting the heating chamber with an exterior of the aerosol provision device; and an inlet conduit, which fluidically connects the or each aperture to the heating chamber;

where the plurality of apertures is arranged at a distal end of the device, the distal end being an opposite end to a mouth end of the aerosol provision device, wherein the plurality of apertures has a combined total area of less than or equal to 4.00 $mm^2$, and wherein the plurality of apertures is configured to reduce the risk of condensate leaking from the aerosol provision device during use.

* * * * *